US006862866B2

(12) United States Patent
Jacobsen et al.

(10) Patent No.: US 6,862,866 B2
(45) Date of Patent: Mar. 8, 2005

(54) AUTOMATIC RECLOSABLE BAG FILLER

(75) Inventors: Sam J. Jacobsen, Middleton, WI (US); Rocky M. Van Asten, Village of Shorewood Hills, WI (US)

(73) Assignee: Protoco Engineering, Inc., Middleton, WI (US)

( * ) Notice: Subject to any disclaimer, the term of this patent is extended or adjusted under 35 U.S.C. 154(b) by 242 days.

(21) Appl. No.: 10/335,547

(22) Filed: Dec. 31, 2002

(65) Prior Publication Data

US 2004/0123569 A1 Jul. 1, 2004

(51) Int. Cl.[7] ..... B65B 43/28

(52) U.S. Cl. ..... 53/412; 53/459; 53/468; 53/469; 53/113.4; 53/139.4; 53/570; 53/284.7; 53/384.1

(58) Field of Search ..... 53/570, 571, 250, 53/247, 284.7, 384.1, 133.4, 139.2, 412, 459, 468, 469

(56) References Cited

U.S. PATENT DOCUMENTS

| | | | | | |
|---|---|---|---|---|---|
| 3,509,689 | A | * | 5/1970 | Perrin | 53/571 |
| 4,132,049 | A | | 1/1979 | Mullins, Jr. | |
| 4,517,788 | A | * | 5/1985 | Scheffers | 53/459 |
| 4,586,319 | A | * | 5/1986 | Ausnit | 53/468 |
| 4,848,064 | A | | 7/1989 | Lems et al. | |
| 4,850,178 | A | * | 7/1989 | Ausnit | 53/570 |
| 5,109,651 | A | | 5/1992 | Stuart | |
| 5,179,816 | A | * | 1/1993 | Wojnicki | 53/133.4 |
| 5,293,757 | A | | 3/1994 | Nishio | |
| 5,337,541 | A | | 8/1994 | Gmuer | |
| 5,375,396 | A | * | 12/1994 | Huwelmann | 53/570 |
| 5,417,039 | A | | 5/1995 | Hansson et al. | |
| 5,458,851 | A | | 10/1995 | Schroeder et al. | |
| 5,655,386 | A | | 8/1997 | Huang et al. | |
| 5,664,406 | A | | 9/1997 | Smith | |
| 5,813,196 | A | | 9/1998 | Page et al. | |
| 6,276,117 | B1 | * | 8/2001 | Wiles | 53/570 |
| 6,286,189 | B1 | | 9/2001 | Provan et al. | |
| 6,474,048 | B1 | | 11/2002 | Metzger et al. | |
| 6,490,846 | B2 | * | 12/2002 | Koppe | 53/459 |
| 6,658,823 | B2 | * | 12/2003 | Johnsen et al. | 53/492 |

* cited by examiner

*Primary Examiner*—Stephen F. Gerrity
(74) *Attorney, Agent, or Firm*—Lathrop & Clark LLP

(57) ABSTRACT

Resealable zipper plastic bags have upwardly protruding support members on each side of the bag mouth which are engaged within downwardly opening channels of two opposed indexer assemblies. With the bag mouth under tension, a slider assembly engages the bag slider, moves it to a fully closed position, then advances the slider to a fully open position. The indexer assemblies are moved toward each other to relieve tension on the bag mouth and cause the mouth to splay open. An insert plate is inserted and rotated to spread the bag mouth for introduction of product through a product chute. Once full, the chute and spreader assembly are withdrawn, tension is applied to the bag mouth, and the slider assembly moves the zipper slider to a fully closed position. The bag support members are then released from the indexer assemblies and the product filled bag is discharged from the apparatus.

22 Claims, 6 Drawing Sheets

AUTOMATIC RECLOSABLE BAG FILLER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to vending apparatus in general, and more particularly to automated devices for filling reclosable bags.

Many vendable products are stored as intermingled quantities of goods, and are then dispensed to customers in bags. When carried out by hand this packaging approach can be labor intensive or unhygienic. An example of this type of product is cube ice.

Although the home freezer is capable of producing ice cubes, sometimes the occasion requires a greater quantity of ice than can be readily produced. Moreover, in some localities, the tap water may not be of a desired purity for producing optimal ice cubes to be placed in drinks. Hence it has long been known to make ice available in bags either as blocks or cubes for consumer purchase. Often this ice is produced off-site and shipped to the retail facility for vending. Where ice production apparatus is available on-site, manual filling of the bags is usually required, which dictates preparation of the bagged ice in batches. Typically the loaded bags of ice will then be stored in a freezer for sale as customers require throughout the day.

Ice cubes which are freshly frozen are often more attractive in terms of clarity and surface character. Moreover, by being stored at freezing temperature, but not significantly below freezing temperature, cubes can be kept from freezing to one another.

Ice machines which dispense ice cubes into plastic bags are known which heat seal the plastic bag to retain the cubes therein. Heat sealed bags have the drawback that they may not be resealed after the initial opening. Resealable plastic bags, such as those offered by S. C. Johnson & Son, Inc. as Ziploc® Brand with Easy Zipper storage bags or the Hefty Slide-Rite® closure from Pactiv Corporation, provide convenient opening and closing of a plastic bag by hand. However, where such bags are filled with product in advance of sale in an automated form, fill, and seal machine, the components of the zipper bag are usually assembled into the final bag after the bag has been filled with product. For example, the bags may be filled inverted through an open bottom, after which a bottom seal is formed, or, alternatively, the zipper assembly may be sealed to one side of the bag at its mouth, the product introduced, and then the zipper assembly is connected to the opposite side of the bag. Such processes usually employ heat sealing and are complicated in that apparatus for actually assembling the bag itself is required.

Automated bag filling apparatus of the heat sealing type can perform advantageously in a controlled environment under the supervision of skilled personnel. However, when placed in a remote position, such as in a retail environment, heat sealing equipment can pose problems, as variations in the plastic composition of the bags and environmental conditions can interfere with optimal performance.

What is needed is a device which can automatically operate and fill a preformed zippered bag without human intervention for rapid, convenient and effective filling.

SUMMARY OF THE INVENTION

The automated bagger of this invention uses resealable zipper plastic bags which have molded plastic tracks on either side of a mouth above a bag interior. A slider is movable from side to side to open and close the mouth of the bag. A support member is fixed to the bag on each side of the mouth. Each support member is a plastic element with a narrow upwardly extending stem and a protuberant semi-spherical head. The bag is suspended from the support members which are engaged within downwardly opening channels formed in two sidewardly opposed indexer assemblies. By displacing one indexer assembly to the side with respect to the other, tension is applied to the bag mouth to facilitate operation of the zipper slider, or by bringing the indexer assemblies closer together, tension is relieved to widen the mouth for insertion of an ice dispensing chute. With the bag mouth under tension, a slider assembly engages the bag slider, moves it to a fully closed position, then advances the slider to a fully open position. The indexer assemblies are moved toward each other to relieve tension on the bag mouth and cause the mouth to splay open. A spreader assembly advances a wide flat insert member or wedge into the bag mouth. The wedge is rotated as it extends into the mouth to spread the bag mouth sufficiently to permit the introduction of a product chute which is mounted on a scissors linkage. Product, such as cube ice, is introduced to the bag through the product chute, and, when the bag is full, the chute and spreader assembly are withdrawn, tension is applied to the bag mouth, and the slider assembly moves the zipper slider to a fully closed position. The bag support members are then released from the indexer assemblies and the product filled bag is discharged from the apparatus.

It is an object of the present invention to provide an apparatus which automatically fills and closes a reclosable plastic bag with product.

It is a further object of the present invention to provide an automated bag filler which operates with an ice maker to provide fresh ice to be bagged on consumer demand.

It is an additional object of the present invention to provide an automated bag filler which introduces product into zipper closure bags, for reclosable operation by the consumer.

It is yet another object of the present invention to provide an automated bagger which can be loaded with a quantity of similar bags in advance of dispensing product.

Further objects, features and advantages of the invention will be apparent from the following detailed description when taken in conjunction with the accompanying drawings.

DESCRIPTION OF THE PREFERRED EMBODIMENTS

Figure 1:
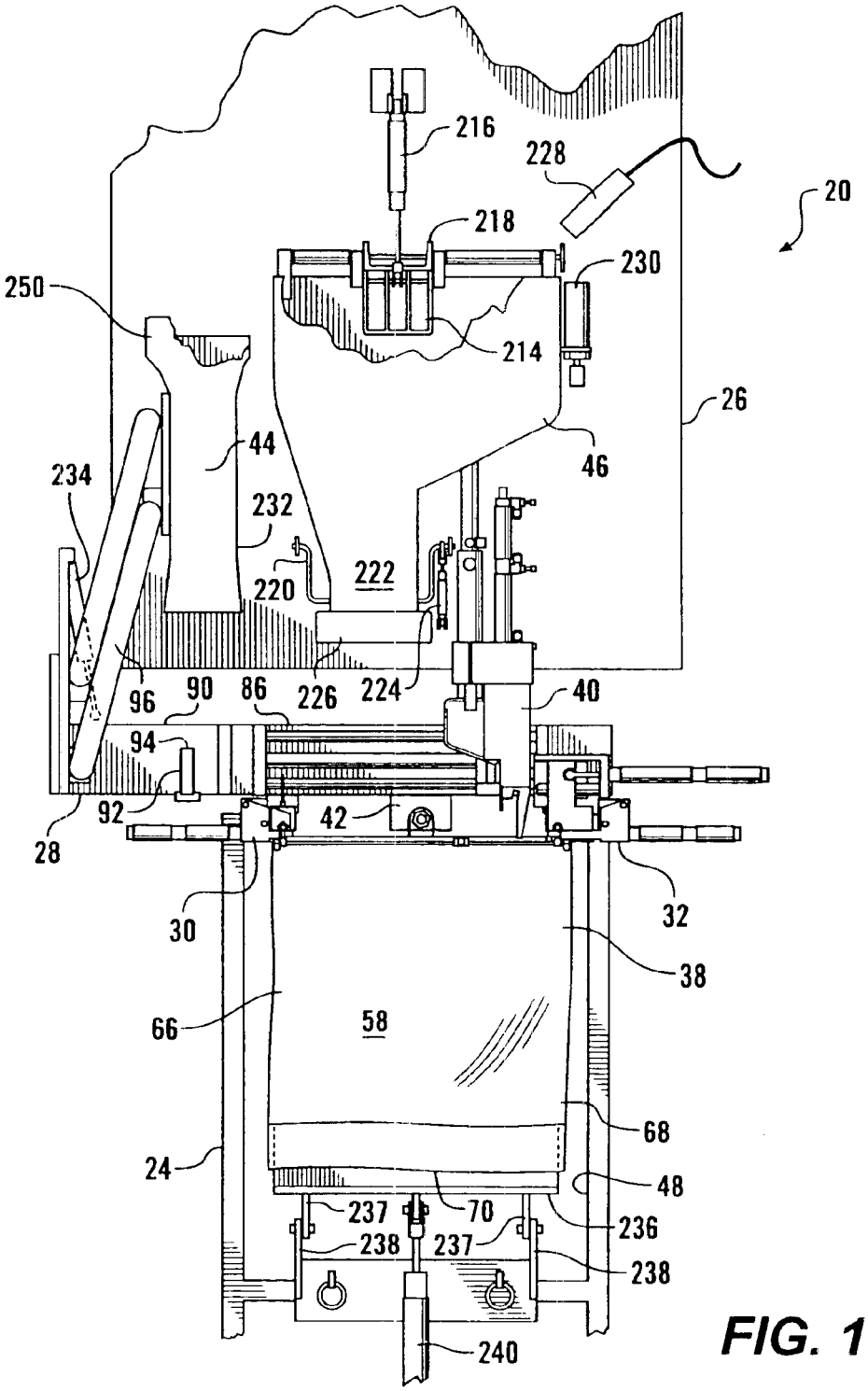
FIG. 1 is a front elevational view of the automated bag filler of this invention.

Referring more particularly to FIGS. 1–8, where like numbers refer to similar parts, an automated bagger 20 is shown in FIG. 1. The bagger 20 will be illustrated in an ice bagging environmental, although it should be understood that the apparatus 20 may be used to dispense other product into a bag. The bagger 20 has an insulated housing 22 having an interior metal frame 24. The moving parts of the bagger are mounted to the frame 24. A conventional ice maker 26 is mounted to the upper part of the frame 24, and a subframe assembly 28 is mounted to the frame 24 below the ice maker. The subframe assembly 28 has two parallel rails 34, 36 from which an array of bags 38 are suspended. A left indexer assembly 30 and a right indexer assembly 32 are mounted to the left rail 34 and right rail 36 respectively, and control the position of the edges of the bags 38. The indexer assemblies 30, 32 serve as bag engaging assemblies which hold the sides of the bag and present a selected bag for operation thereon by other elements of the apparatus. A slider assembly 40 moves with respect to the forwardmost bag 38 to open and close the bag. A pusher assembly 42 is mounted beneath the rails 34, 36 and moves from front to back to position the forwardmost bag. A lower product chute assembly 44 is positionable to communicate between the interior of the bag 38 and an upper product chute assembly 46 which forms a part of the ice maker 26.

Figure 2:
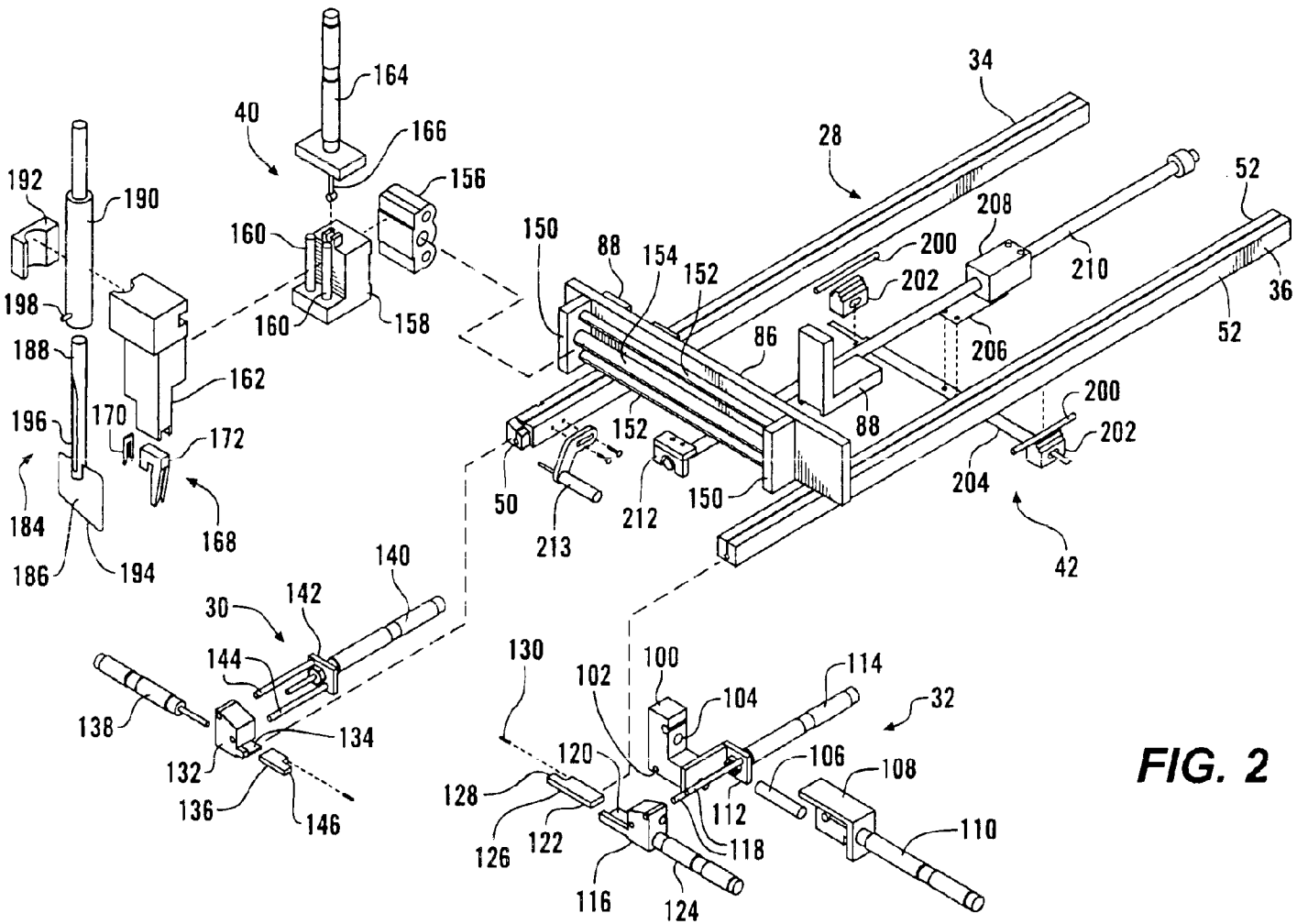
FIG. 2 is a fragmentary exploded isometric view of the automated bag filler of FIG. 1.
Figure 7:
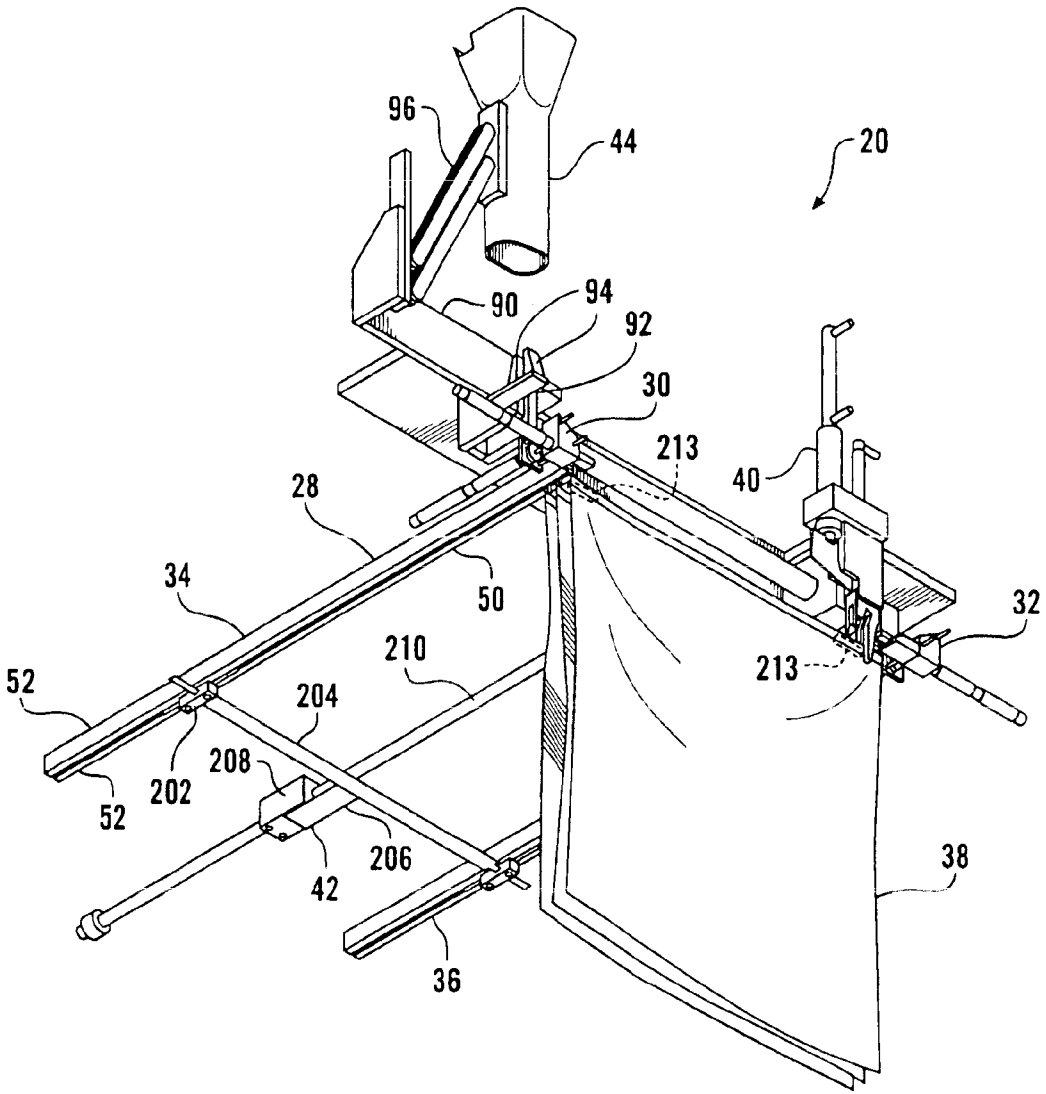
FIG. 7 is a bottom isometric view of the automated bag filler of FIG. 1.
Figure 8:
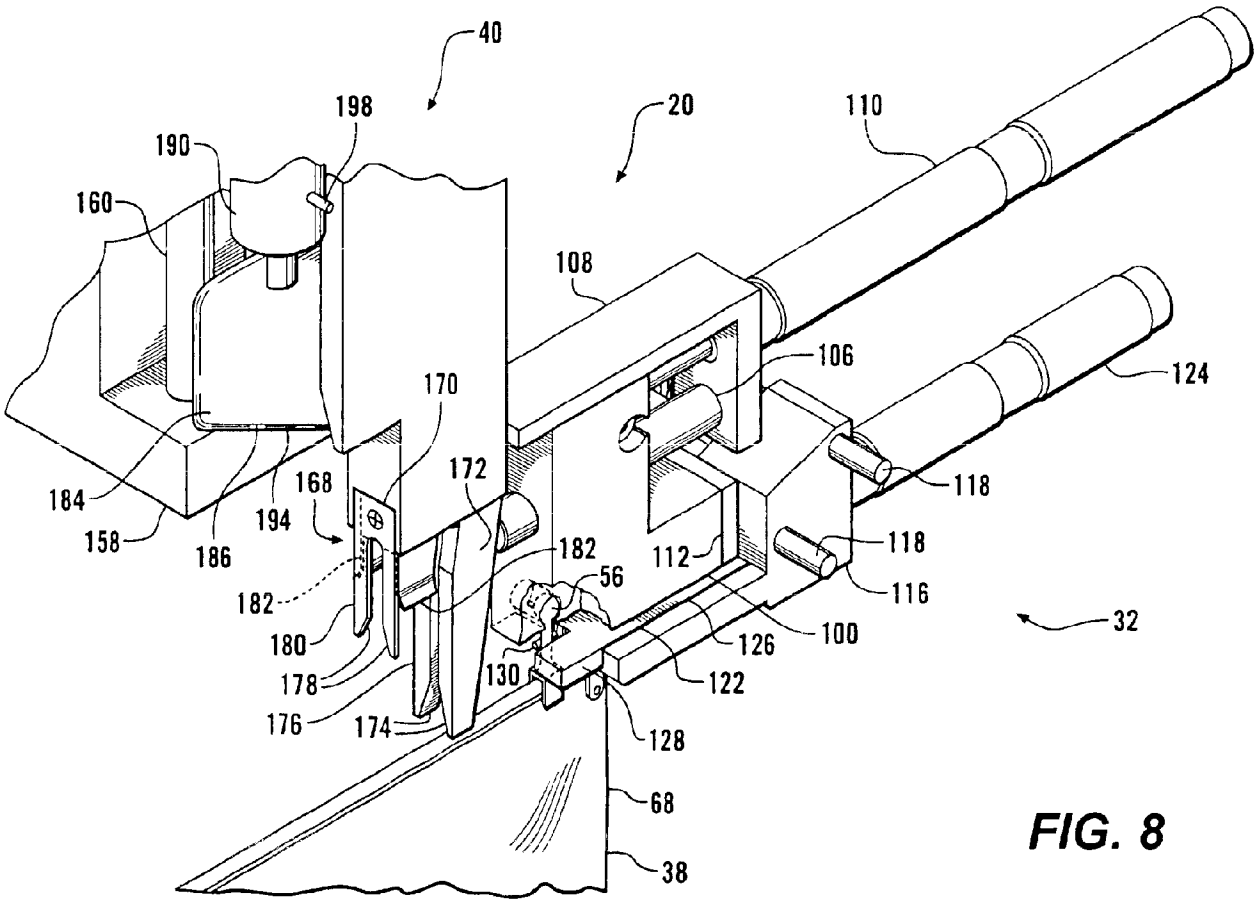
FIG. 8 is an enlarged fragmentary view of the engagement of the right support member of a bag within the right indexer assembly.

The frame 24 is formed of welded steel square tubing which defines an interior volume 48 and which supports the subframe assembly 28 at approximately waist height. As shown in FIGS. 2 and 7, the left rail 34 and the right rail 36 extend parallel to one another in a front to back direction which will sometimes be referred to as the machine direction. The direction perpendicular to the machine direction may be referred to as the cross machine direction. Each rail 34, 36 has a downwardly opening channel 50 which extends in the machine direction and which has a generally diamond shaped cross section. The lower portion of the diamond shape is truncated to define the lower opening of the channels 50. For ease of manufacture each rail 34, 36 may be assembled from two half rail segments 52.

Figure 5:
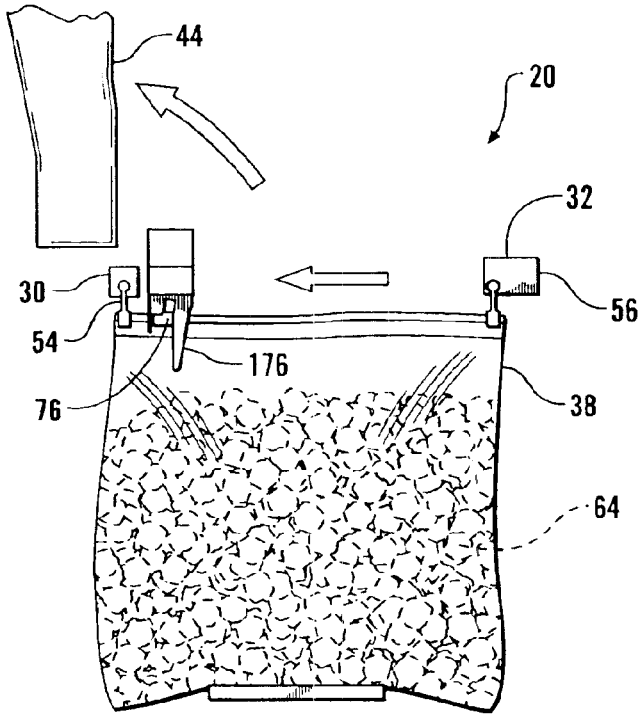
FIG. 5 is a schematic view of the automated bag filler of FIG. 4 showing the product filler chute retracted and the slider returned to a bag closed position.
Figure 6:
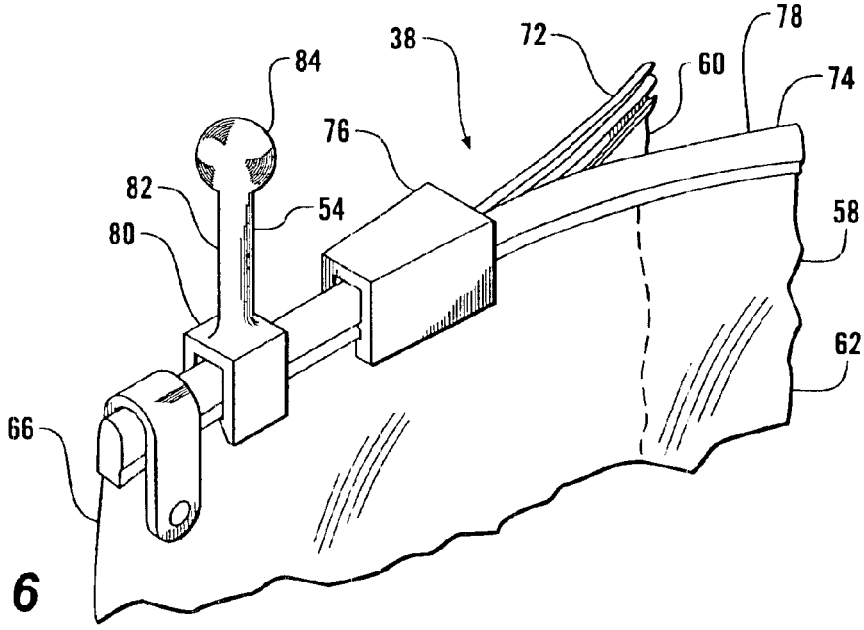
FIG. 6 is an enlarged fragmentary view of the reclosable slider zipper bag of this invention having an upwardly protruding support member.

The rails 34, 36 support an array of specially configured bags 38. Each bag 38 is similar to a conventional resealable plastic bag, such as those offered by S. C. Johnson & Son, Inc. as Ziploc® Brand with Easy Zipper storage bags or the Hefty Slide-Rite® closure from Pactiv Corporation. However, the bags 38 are modified as shown in FIG. 6 and FIG. 5 by the provision of a left support member 54 and a right support member 56. Each bag 38 is preferably formed of transparent plastic material and has a front wall 58 joined to a rear wall 60 to define a bag interior 62 which is configured to receive a quantity of ice 64 produced by the ice maker 26. The front wall 58 is joined to the rear wall 60 along a left edge 66, a right edge 68, and a bottom edge 70. As is conventional in reclosable zipper storage bags, a molded rear track 72 is fixed to the upper edge of the rear wall 60, and a molded front track 74 is fixed to the upper edge of the front wall 58. A zipper slider 76 receives the front track 74 and the rear track 72 such that movement of the slider 76 in the cross machine direction to the left causes the tracks 72, 74 to separate, while movement of the slider to the right joins the two tracks together.

The bag mouth 78 is defined between the rear track 72 and the front track 74 and defines the entrance to the bag interior 62. Each support member 54, 56 has a base 80 which engages with the joined rear track 72 and front track 74 adjacent an upper corner of the bag 38. The base 80 may be ultrasonically or heat welded to the bag or may be mechanically fastened. Each support member 54, 56 has a narrow stem 82 which projects upwardly from the base 80 and which terminates in a protuberant head 84 which may take the form of portions of a ball. The ball-like head 84 is positioned by the stem 82 at a position elevated above the level of the bag mouth 78.

The support members 54, 56 are engaged within the channels 50 of the parallel rails 34, 36. The upper edges of the bags 38 are thus retained equally spaced and the generally flexible bags are controllably positioned in the machine direction. Moreover, because the ball-like support member heads 84 are retained by the interior walls of the channels 50, cross machine direction movement of the corners of the bags is controlled.

The subframe assembly 28 includes a back plate 86 which is mounted to the rails 34, 36 by two angle brackets 88. A right angle side bracket 90 extends to the left of the back plate 86 to support the lower product chute assembly 44. An alignment fork 92 extends frontwardly of the side bracket 90 and has two upwardly extending members 94 which serve to engage and restrain the scissors links 96 of the lower product chute assembly 44.

The left indexer assembly 30 and the right indexer assembly 32 cooperate to receive a bag 38 from the rails 34, 36, to advance the bag into loading position and to apply and relieve tension on the mouth 78 of the bag. Both indexer assemblies 30, 32 engage a support member at a corner of the bag 38 and are capable of moving that support member frontwardly in the machine direction. The right indexer assembly 32 in addition has the capability to move the engaged support member 56 to the side in the cross machine direction to apply and relieve tension on the bag mouth 78.

The right indexer assembly 32 has a tension block 100 which is positioned forward of the right rail 36 and which has a downwardly opening channel 102 which is aligned with and is coaxial with the channel 50 in the right rail. The tension block 100 has a cross machine direction opening 104 above the channel 102 into which a rod 106 extends in sliding engagement. The rod 106 is fixed to a main bracket 108 which is itself secured to the right rail 36. A tension block actuator 110 is mounted to the main bracket 108, with the piston of the actuator 110 being connected to the tension block 100 such that the tension block may be caused to move in the cross machine direction along the rod 106.

A right angle shuttle bracket 112 is fixed to the tension block 100 below the rod 106 and supports a shuttle actuator 114 which extends in the machine direction. A shuttle 116 is connected to the piston of the shuttle actuator 114 and moves in the machine direction along two parallel shuttle rods 118.

The shuttle 116 has a platform 120 which is positioned directly below the tension block 100. A gap hand member 122 overlies the platform 120 and has portions which extend below the channel 102 in the tension block 100. The gap hand member 122 is moved in a cross machine direction by a gap hand actuator 124 which is mounted to the shuttle 116.

The gap hand member 122 has a body 126 which is rectangular in plan and from which a front finger 128 extends in the cross machine direction towards the left indexer assembly 30. The finger 128 is approximately half the width of the body 126 of the gap hand member 122. A restraint pin 130 extends in the cross machine direction from the body and is about half the length of the front finger 128. As will be discussed in more detail below, the right support member 56 of a bag 38 is engaged with the tension block 100 with the spherical head 84 projecting into the channel 102 and the stem 82 being restrained from forward movement by the front finger 128 and from rearward movement by the restraint pin 130 until such time as the gap hand member 122 is withdrawn by the gap hand actuator 124 to allow the bag 38 to be discharged from the apparatus 20.

As shown in FIG. 2, the left indexer assembly 30 is mounted to the left rail 34 and supports a shuttle 132 having a platform 134 on which a gap hand member 136 slides in the cross machine direction in response to the force applied by a gap hand actuator 138 which is fixed to the shuttle. A shuttle actuator 140 is mounted to a shuttle bracket 142 and engages the shuttle 132 for movement in the machine direction on two parallel rods 144 which extend from the shuttle bracket. The gap hand member 136 has a front finger 146 which is spaced ahead of a restraint pin 148. It will be noted that the left indexer assembly 30 engages the left support member 54 of a bag 38 when the gap hand member 136 is positioned beneath the forwardmost portion of the channel 50 in the left rail 34. The left indexer assembly 30 is operated in conjunction with the right indexer assembly 32 to move the bag 38 frontwardly. It will be noted that while the right indexer assembly 32 can move the bag support member 56 in both the machine direction and the cross machine direction, the left indexer assembly need only move the bag support member 54 in the machine direction.

The slider assembly 40, as shown in FIG. 2, provides a mechanism which operates on the zipper slider 76 of the bag 38 to locate and manipulate the slider for purposes of opening and closing the bag 38. Two side plates 150 mount two horizontal parallel rods 152 and a central actuator 154 to the back plate 86. A bearing bracket 156 slides in the cross machine direction on the rods 152 as driven by the central actuator 154. A base member 158 is fastened to the bearing bracket 156 and has two vertically extending rods 160 to which a riser block 162 is mounted for vertical motion. A vertical actuator 164 is fixed to the riser block 162 and has a piston 166 which is connected to the base member 158. The slider assembly 40 advantageously works to engage the bag zipper slider 76 regardless of where the zipper slider 76 is located on a particular bag.

Mounted to the underside of the riser block 162 is a slider engagement member 168 which may be comprised of two elements: a plate 170 which is connected by a screw to an engagement member segment 172 preferably formed as a powder metallurgy part. The engagement member segment 172 has two tines 174 on the right which define a locating fork 176. Each tine 174 has an inwardly facing bevel, such that when the locating fork 176 descends on a bag 38, the sides of the bag will be directed between the two tines 174. The plate 170 also has two downwardly extending beveled tines 178 which define an operating fork 180 which is spaced from the locating fork 176 in the cross machine direction approximately the length of the bag zipper slider 76. Two outwardly splayed gripping tabs 182 extend downwardly between the locating fork 176 and the operating fork 180.

The locating tines 174, being the first portions to make contact with the bag 38, are substantially longer than the operating tines 178. As described in more detail below, the locating fork 176 serves to position the bag zipper slider 76 for engagement by the slider engagement member 168, while the operating fork 180 and gripping tabs 182 engage the slider when it is moved to open or close the bag 38. The slider engagement member 168 is raised and lowered by the actuator 164 and is moved from side to side by the central actuator 154.

In order to effectively and repeatably introduce product into the bag, it is important to form an opening in the bag mouth at a predictable position into which the product chute can be inserted. A spreader assembly 184 is mounted to the riser block 162 and moves with the riser block. The spreader assembly 184 provides a means for creating an opening in the bag mouth of a determined machine direction width. The spreader assembly 184 serves to create the expanded mouth opening in a way that allows for wide variations in the structure or material attributes of the particular bag which is presented at any time. The spreader assembly 184 has an insert member or wedge plate 186 which is fixed to a vertical shaft 188 which is received within a vertical shaft guide 190 which is fixed to the riser block 162 by a clamp 192. The insert member 186 is thus movable vertically to be inserted into and retracted from the mouth of the bag The wedge plate 186 has a double beveled lower edge 194. The edge 194 is angled downwardly to the right at about 45 degrees from the horizontal. The shaft 188 has a cam slot 196 into which a pin 198 extends from the shaft guide 190. The cam slot 196 extends substantially vertically for about the first two-thirds of its length, then the cam slot 196 describes a spiral around the shaft 188 over the last third of its length and turns 90 degrees. The effect of the cam slot 196 is to rotate the wedge plate 186 from a position aligned with the cross machine direction when it is inserted into the mouth of a bag 38, but to then take on a position perpendicular to the cross machine direction when it is fully extended into the bag. The effect of this motion is to spread the mouth 78 of the bag 38.

As shown in FIG. 7, the pusher assembly 42 is mounted beneath the rails 34, 36. A pusher rod 200 extends in the machine direction within each of the rail channels 50. The pusher rods 200 slide freely within the channels 50 and engage against the heads 84 of the support members 54, 56 of the rearwardmost bags 38. The pusher rods 200 are fastened to underlying pusher blocks 202 which are connected by a stiff tie link 204. The tie link 204 extends in the cross machine direction to connect both pusher rods 200 to a spacer plate 206 which is fastened to a traveler block 208 which moves in the machine direction on an actuator 210. The actuator 210 is mounted to the back plate 86 by a bracket 212.

Two retractable bag stops 213 are shown in FIG. 7, but are omitted for clarity from the other views. Each bag stop 213 is a pneumatic actuator with a retractable pin which moves in a cross machine direction directly below one of the rails 34, 36. A bag stop is mounted to each rail 34, 36, immediately behind each of the left indexer assembly 30 and the right indexer assembly 32. The bag stop pin extends at a height below the heads of the support members, but above the level of the bag mouth. The bag stop pins thus prevent the escape of rearward bags 38 when the forwardmost bag is being filled with ice.

Product such as ice is introduced into a bag 38 by the cooperation of the upper product chute 46 and the lower product chute assembly 44. As shown in FIG. 1, the upper product chute 46 is mounted to the ice maker 26 and receives ice when the ice maker cover 214 is lifted by the ice maker cover actuator 216. The upper product chute 46 is pivotably mounted along its upper edge at a hinge 218. A U-shaped wire 220 is hinged near the lower throat 222 of the upper product chute 46. An actuator 224 is connected by a link to the U-shaped wire 220, such that rotation of the U-shaped wire 220 causes the lower throat 222 to move frontwardly. When the actuator 224 is relaxed, the lower throat 222 remains adjacent a drain platform 226 which is plumbed to remove any melted remains of any accumulated ice. A level sensor 228 detects the presence of ice within the upper chute. A vibrating actuator 230 is mounted to the upper chute 46. The rapid operation of the vibrating actuator 230 applies a mechanical shock to the upper product chute 46 dislodging any ice fragments and assisting them to travel downwardly through the chute.

The lower product chute assembly 44 has a square tubular lower chute 232 with a cutaway inlet suited to mate with the lower throat of the upper product chute 46. The two scissors links 96 are pin-connected to the side of the lower chute 232 and are driven by an actuator 234 to move the lower chute from a retracted position to the left of the upper chute 46 to an extended position beneath the upper chute. It will be noted that, because of the scissors linkage, the lower chute 232 remains substantially vertical throughout its travel.

As shown in FIG. 1, a lift platform 236 is mounted to the frame 24 beneath the forwardmost bag 38. The lift platform 236 is a generally horizontally extending plate pivotably mounted by two downwardly and rearwardly extending arms 237 to ears 238 extending from the frame 24. A double-acting actuator extends from the frame 24 to the lift platform 236. The lift platform 236 is positioned such that it supports the bag 38 as it is filled with ice, and, in an elevated position, relieves tension on the mouth 78 of the bag to facilitate closing of the zipper slider 76.

Although any effective actuator, mechanical, electronic, magnetic, or hydraulic, may be used in the apparatus 20, the actuators are preferably pneumatic actuators. All the actuators are under the control of an electronic controller, not shown, which may be a programmable logic controller (PLC) or other digital computer or analog controller. The apparatus 20 is also provided with a number of electronic eye detectors or limit switches, not shown, to confirm that each element of the apparatus 20 is operating effectively and that the various consumables, i.e. bags and ice, are present when required to be operated upon.

The ice maker 26 preferably receives water from a water purification and filtration system such as the systems supplied by Western Water International, Inc., of Forestville, Md. www.wwintl.com, using for example reverse osmosis techniques. If desired, the housing 22 may be provided with a dispenser to bypass the ice maker and dispense water directly to the customer in a water bottle, cup, or jug.

When a customer desires a freshly filled bag of ice, it is only necessary to depress an activating button, not shown, on the housing 22. This button sends a signal to the controller to begin a sequence of events which will result in a bag 38 being filled with ice and dispensed in about one minute.

First, the two bag stops 213 are retracted to clear the way for an empty bag 38 to be advanced into the indexer assemblies. The pusher assembly 42 is then activated such that the pusher actuator 210 advances the two pusher rods 200 until a bag is in position to be engaged by the indexer assemblies. Sensors, such as optical sensors, may be provided to determine when the bags are adequately advanced. The pusher rods 200 bear against the support member heads 84 of the rearmost bag's support members. This force is carried through the other support member heads to advance all the bags and to cause the forwardmost bag 38 to advance such that its support members 54, 56 are received within the left indexer assembly 30 and right indexer assembly 32. The support members of the forwardmost bag 38 are halted when the stems 82 abut against the front fingers 128, 146 of the gap hands 122, 136. After the pusher rods 200 are halted, they are retracted to a rearward position.

The bag stops 213 are then actuated to insert pins rearwardly of the forwardmost bag 38 and the indexer assemblies 30, 32, thereby preventing further advancement of the bags behind the forwardmost bag.

With the support members of the forwardmost bag received within the indexer assemblies 30, 32, the gap hand members 122, 136 are advanced by the gap hand actuators 124, 138 to interpose the restraint pins 130, 148 rearwardly of the stems 82 of the forwardmost bag support members. At this point, the forwardmost bag 38 is fully engaged by the indexer assemblies 30, 32.

The left shuttle 132 and right shuttle 116 are then moved forward by the shuttle actuators 114, 140 to bring the bag mouth 78 into position beneath the slider assembly 40.

To prepare the bag 38 for opening, tension is applied by withdrawing the tension block 100 of the right indexer assembly 32 along the rod 106 by means of the actuator 110. The tension block 100 is moved away from the left indexer assembly 30 to remove slack from the bag mouth 78.

With tension applied to the bag 38, the slider assembly 40, beginning at a home position adjacent the right indexer assembly 32, is operated to cause the vertical actuator 164 to lower the riser block 162 to bring the slider engagement member 168 into an intermediate down position in which the locating fork 176 tines 174 are positioned to straddle the bag and to engage the bag zipper slider 76. The central actuator 154 is then operated to move the slider fully to the left. By traversing the full width of the bag mouth with the slider engagement member 168, the apparatus is sure to engage the slider 76, even if it is not in an open position.

Figure 3:
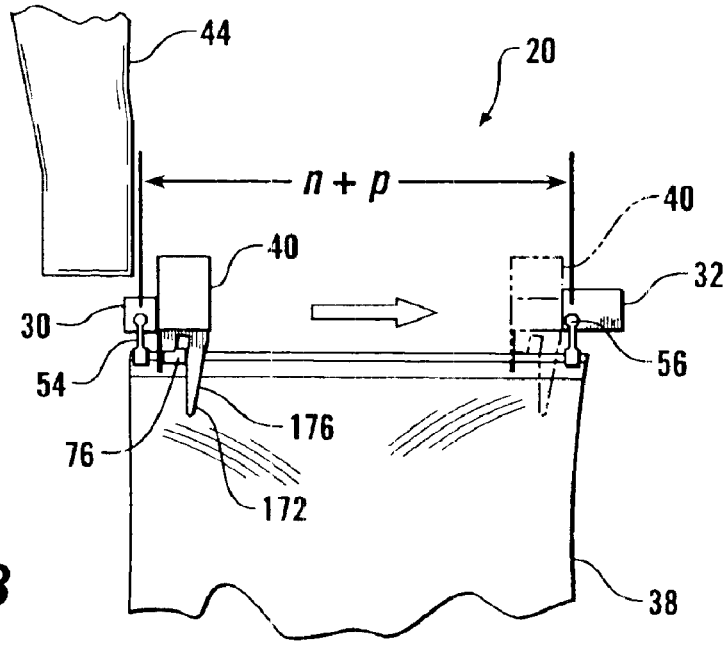
FIG. 3 is a schematic view of the automated bag filler of FIG. 1 showing the slider assembly opening the bag mouth.
Figure 4:
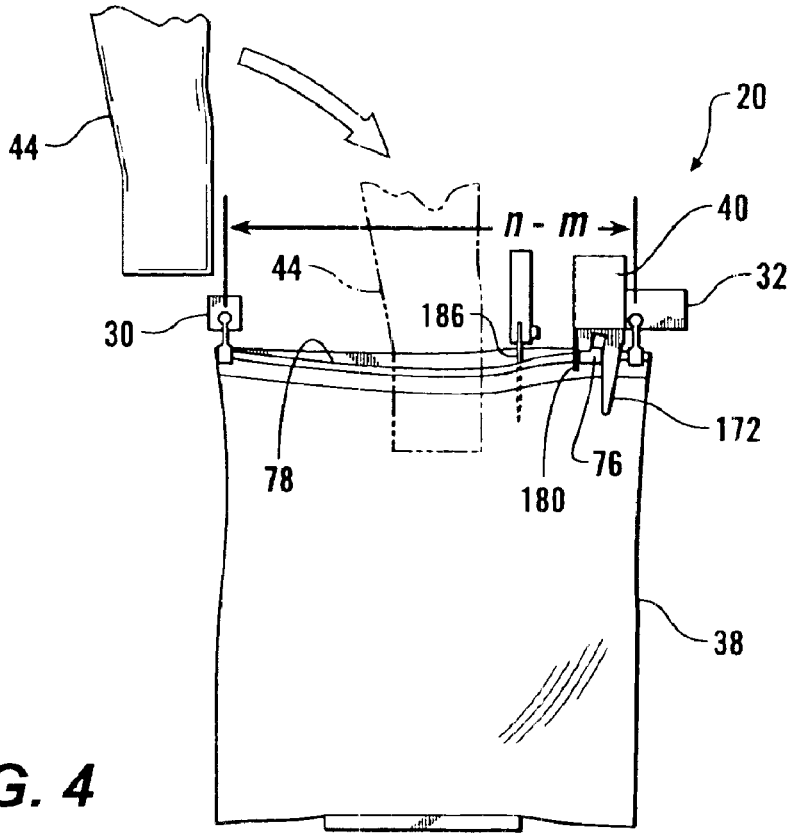
FIG. 4 is a schematic view of the automated bag filler of FIG. 3 showing the spreader assembly inserted within the bag mouth and the product filler chute introduced into the bag.

When the slider engagement member 168 has reached the full left position, adjacent the left indexer assembly 30, the vertical actuator 164 is operated to drive the slider engagement member 168 down to its lowest position, in which the operating fork 180 and the gripping tabs 182 are in position to engage the slider 76. The central actuator 154 is then operated to move the engaged slider 76 to the full right position and thus open the mouth 78 of the bag 38, as shown in FIG. 3.

With the mouth of the bag 38 open, the right indexer assembly tension block 100 is moved by the actuator 110 to its leftmost position. The tension block 100 thus returns to its starting position, then moves past the right rail, to a position leftward of the right rail. The effect of this movement is to shorten the distance between the two support members of the flexible bag, and to cause the width of the bag mouth to increase, preparing it to receive the wedge plate 186.

The spreader assembly 184, which, being mounted to the riser block 162, travels alongside it, is then operated to drive the shaft 188 downward through the shaft guide 190, to insert the wedge plate 186 into the open bag mouth. As the wedge plate enters the bag mouth 78, it is aligned in a cross machine direction so that the plate readily enters the narrow mouth opening. As the wedge plate 186 approaches its lowest position, the spiral portion of the cam slot 196 engages the pin 198, and the wedge plate is rotated 90 degrees to spread the mouth of the bag to create an opening about two inches wide, which is sufficiently wide to receive the lower product chute 232.

The actuator 232 is operated to advance the scissors linkage 234 to move the lower product chute 232 to the right and downwardly such that the lower end of the product chute extends fully into the bag 38, and the upper end is positioned to receive ice from the upper product chute assembly 44. The lower product chute 232 rests in its dispensing position with the lower scissors link 96 supported on the alignment fork 92. The upper end of the lower product chute 232 has a widened segment 250 which is cut away in the rear. The actuator 224 is then operated to pivot the U-shaped wire 220 and cause the lower throat 222 of the upper product chute assembly 44 to pivot frontwardly and engage with the widened segment 250 of the lower product chute 232.

Once a conduit is thereby established between the ice machine and the interior of the bag 38, the actuator 216 is operated to pivot the ice maker cover 214 and to thereby allow product to flow from the ice maker 26, through the upper product chute and the lower product chute into the bag. To support the bag as ice is received therein, the actuator 240 positions the lift platform 236 to engage the base of the bag.

Sensors such as weight sensors, motion sensors, or time sensors based on know rate of flow, or other appropriate metering technology may be employed to control the flow of product into the bag so as not to exceed bag capacity. Once the desired quantity of ice has been dispensed into the bag 38, the ice maker cover 214 is closed, and the upper product chute is retracted. With the upper product chute now positioned rearwardly of the lower product chute, the lower product chute is moved on the scissors linkage 96 and returned to its original position. The wedge plate 186 is then raised to its initial position clearing the mouth 78 of the bag 38.

The right indexer assembly 32 is then moved to its rightwardmost position in a fashion similar to that described above with respect to the tensioning of the bag prior to the bag opening. The lift platform 236 is then lowered several inches to allow the ice to settle into the base of the bag and clear the upper regions of the bag to allow the zipper slider to be closed. The lift platform 236 may then be raised to remove some tension from the bag mouth to facilitate the impending closing.

The slider assembly 40, which, it will be noted, has remained in its rightwardmost position throughout the filling of the bag 38, is actuated to lower the riser block 162 to its full down position so that the operating fork 180 and the gripping tabs 182 engage the slider 76. The central actuator 154 is then operated to move the engaged slider 76 to the full left position and thus close the mouth 78 of the bag 38. Once closed, the slider assembly is elevated to its full up position.

To discharge the loaded bag 38 from the apparatus 20, the gap hand members 122, 136 are retracted to their outwardmost positions, and the right shuttle 116 and left shuttle 132 are moved forward to propel the bag support members 54, 56 out of the channels 50. The bag 38 is then supported entirely on the lift platform 236, which is pivoted downwardly by the actuator 240 to cause the ice filled bag 38 to drop down a dispensing chute for retrieval by the customer.

Where ice cubes have been discussed above, it should be noted that all types of small manufactured ice may be dispensed and bagged by the apparatus 20, including what are commonly referred to as cube, supercube, contour, flake, superflake, nugget, and scale ice products. Moreover, ice cubes have been discussed as an example of product which may be dispensed in the automated bagger. Other products, such as granulated or powdered food items, small fruits and vegetables, nuts, etc. may also be dispensed.

Where pneumatic actuators and controls have been disclosed, other actuators may be employed, such as linear actuators, stepper motors, magnetic or mechanical or gear actuators.

It should be noted that the bag support members may take other forms than that illustrated, for example the stem may be longer or shorter, or omitted. The head need not be semi-spherical, but may be other regular or irregular shapes.

It is understood that the invention is not limited to the particular construction and arrangement of parts herein illustrated and described, but embraces all such modified forms thereof as come within the scope of the following claims.

We claim:

1. An apparatus for filling a reclosable bag with objects, the bag having a rear track, and a mating front track selectably engagable with the rear track, wherein a bag mouth is defined between the front track and the rear track above a bag interior, and wherein a slider is operable to open and close the bag mouth, the apparatus comprising:

a frame;

a first rail mounted to the frame and extending in a front to back direction;

a second rail mounted to the frame opposed to the first rail, wherein a plurality of reclosable bags are supportable between the first rail and the second rail to define a supply of reclosable bags;

a right indexer assembly mounted to the frame and positioned to engage a first end of a selected reclosable bag from the supply of reclosable bags;

a left indexer assembly mounted to the frame and positioned to engage a second end of said selected reclosable bag opposite the first end, with the bag mouth extending between the first end and the second end;

a spreader assembly mounted to the frame and having a wedge with a narrow dimension and a wide dimension of greater dimension than the narrow dimension, the wedge being movable between a first position spaced from the selected reclosable bag mouth, and a second position in which the wedge is inserted into the bag mouth and interposed between the rear track and the front track of said selected reclosable bag, the wedge being mounted for rotation about a vertical axis to permit the wedge to be rotated between an inserted orientation in which the narrow dimension separates the rear track from the front track a first amount, and a filling orientation, in which the wide dimension separates the rear track from the front track a second, greater amount to define a filling opening;

an object dispensing chute mounted to the frame, and in communication with a source of objects, the chute being adjustable to communicate with said filling opening to permit the insertion of objects from the source of objects into the selected bag; and a controller operable to insert the wedge into the selected bag and to cause the object dispensing chute to thereafter communicate with the source of objects to introduce objects into the selected bag.

2. The apparatus of claim 1 wherein the object dispensing chute is mounted to the frame to be removed from communication with the source of objects by pivoting upwardly.

3. The apparatus of claim 1 further comprising a slider assembly mounted to the frame for movement between the first rail and the second rail, the slider assembly having portions which are positioned to engage the bag slider and cause it to move with the slider assembly.

4. The apparatus of claim 3 wherein the slider assembly portions which are positioned to engage the bag slide comprise an engagement member having two tines which define a locating fork, the engagement member being mounted for vertical movement, such that when the locating fork descends on a bag, the sides of the bag will be directed between the two tines.

5. The apparatus of claim 3 wherein the spreader assembly is mounted to the slider assembly for movement together with the slider assembly.

6. The apparatus of claim 1 wherein the first rail and the second rail have downwardly opening channels which receive upwardly protruding portions of the plurality of bags.

7. The apparatus of claim 1 further comprising a pusher assembly mounted to the first rail and the second rail, and having elements which engage against portions of the plurality of bags to urge the bags frontwardly towards the right indexer assembly and left indexer assembly.

8. An apparatus for filling a reclosable bag with objects, the bag having a rear track, and a mating front track selectably engagable with the rear track, wherein a bag mouth is defined between the front track and the rear track above a bag interior, and wherein a slider is operable to open and close the bag mouth, the apparatus comprising:

a frame;

a right bag engaging assembly mounted to the frame and positioned to engage a first end of a reclosable bag;

a left bag engaging assembly mounted to the frame and positioned to engage a second end of said reclosable bag opposite the first end, with the bag mouth located between the first end and the second end; and a spreader assembly mounted to the frame and having a retractable insert member with a narrow dimension and a wide dimension of greater dimension than the narrow dimension, the insert member being vertically movable between a first position spaced above the reclosable bag mouth, and a second lower position in which the insert member is inserted into the bag mouth and interposed between the rear track and the front track of the reclosable bag, the insert member being rotatable about a vertical axis to permit the wedge to be rotated between an initial inserted orientation in which the narrow dimension separates the rear track from the front track a first amount, and a filling orientation, in which the wide dimension separates the rear track from the front track a second, greater amount to define a filling opening for the receipt therein of objects.

9. The apparatus of claim 8 further comprising:

a source of objects mounted to the frame;

a lower object dispensing chute mounted to the frame for movement between a first position in which lower portions of the chute extend into a bag mouth, and an upper position in which the chute is clear of a bag; and an upper object dispensing chute which communicates between the source of objects and the lower object dispensing chute when it is in the first position.

10. The apparatus of claim 8 further comprising a slider assembly mounted to the frame for movement along the bag mouth, the slider assembly having portions which are positioned to engage the bag slider and cause it to move with the slider assembly.

11. The apparatus of claim 10 wherein the slider assembly portions which are positioned to engage the bag slide comprise an engagement member having two tines which define a locating fork, the engagement member being mounted for vertical movement, such that when the locating fork descends on a bag, the sides of the bag will be directed between the two tines.

12. The apparatus of claim 10 wherein the spreader assembly is mounted to the slider assembly for movement together with the slider assembly.

13. An apparatus for filling a reclosable bag with objects, the bag having a rear track, and a mating front track selectably engagable with the rear track, wherein a bag mouth is defined between the front track and the rear track above a bag interior, and wherein a slider is operable to open and close the bag mouth, and the bag having a left support member which extends from the bag above the bag mouth, and a right support member which extends from the bag above the bag mouth, the apparatus comprising:

a frame;

a first rail mounted to the frame and extending in a front to back direction;

a second rail mounted to the frame parallel to the first rail, wherein the first rail and the second rail have downwardly opening channels defined therein, such that the first rail channel engages the bag left support member, and the second rail channel engages the bag right support member;

a pusher assembly mounted to the frame for frontward motion between a retracted position and an advanced position;

a right indexer assembly mounted to the frame, and having a downwardly opening channel which communicates with the second rail channel to receive a right bag support therein;

a left indexer assembly mounted to the frame and having a downwardly opening channel which communicates with the first rail to receive a left bag support therein;

a spreader assembly mounted to the frame and movable between a first position spaced from a bag mouth, and a second position in which an insert member is inserted into a bag mouth and interposed between the rear track and the front track of said bag;

an upper product chute mounted to the frame, and in communication with a source of ice;

a lower product chute mounted to the frame and having an upper opening into which ice enters, and a lower opening, out of which product is discharged, the lower product chute being movable between a first position in which the lower product chute lower opening is spaced from said bag mouth, and a second position in which the lower product chute upper opening is in communication with the upper product chute, and the lower product chute lower opening is in communication with the bag mouth, to permit product to pass from the source of product to the interior of said bag;

a controller operable to activate the pusher assembly to advance a frontmost bag to engage the left support member of the frontmost bag with the left indexer assembly, and to engage the right support member with the right indexer assembly, and wherein the indexer assemblies are operable to move away from each other to apply tension to the bag at the mouth, and to move closer to each other to introduce slack into the bag at said mouth to allow the mouth to be opened by the insertion of the wedge of the spreader assembly.

14. The apparatus of claim 13 wherein the lower product dispensing chute is mounted to the frame with a scissors linkage.

15. The apparatus of claim 13 further comprising a slider assembly mounted to the frame for movement between the right indexer assembly and the left indexer assembly, the slider assembly having portions which are positioned to engage the bag slider and cause it to move with the slider assembly.

16. The apparatus of claim 15 wherein the slider assembly portions which are positioned to engage the bag slide comprise an engagement member having two tines which define a locating fork, the engagement member being mounted for vertical movement, such that when the locating fork descends on a bag, the sides of the bag will be directed between the two tines.

17. The apparatus of claim 15 wherein the spreader assembly is mounted to the slider assembly for movement together with the slider assembly.

18. A method for filling a reclosable bag with product, the bag having a rear track, and a mating front track selectably engagable with the rear track, wherein a bag mouth is defined between the front track and the rear track above a bag interior, and wherein a slider is operable to open and close the bag mouth, and the bag having a left support member which extends from the bag above the bag mouth, and a right support member which extends from the bag above the bag mouth, the method comprising the steps of:

advancing the bag frontwardly to a forward position and engaging the bag left support member with a left shuttle, and the bag right member with a right shuttle;

blocking rearward motion of the bag;

increasing the distance between the bag left support member and the bag right support member to apply tension to the bag mouth;

engaging the bag slider and moving it to open the bag mouth;

decreasing the distance between the bag left support member and the bag right support member to release tension on the bag mouth;

inserting a wedge into the open bag mouth and adjusting the position of the web to increase the maximum width of the mouth into the bag interior;

inserting a product fill chute through the bag mouth;

discharging product through the fill chute into the bag interior;

retracting the fill chute and the wedge from the bag mouth;

increasing the distance between the bag left support member and the bag right support member to apply tension to the bag mouth;

engaging the slider and advancing it to close the bag; and releasing the engagement between the bag left support member and the left shuttle, and the bag right member with the right shuttle, to discharge the closed bag, with product contained therein to a customer.

19. An apparatus for filling a reclosable bag with objects, the bag having a rear track, and a mating front track selectably engagable with the rear track, wherein a bag mouth is defined between the front track and the rear track above a bag interior, and wherein a slider is operable to open and close the bag mouth, and the bag having a first side and a second side on opposite sides of the bag mouth, the apparatus comprising:

a frame;

a first indexer assembly mounted to the frame which engages the first side of the bag;

a second indexer assembly mounted to the frame which engages the second side of the bag; the second indexer assembly being movable toward and away from the first indexer, the second indexer being operable to in a first position apply tension to the bag mouth, and in a second position spaced more closely to the first indexer, to relieve tension on the bag mouth;

a slider assembly mounted for movement between the bag first side and the bag second side, the slider assembly having portions which are positioned to engage the bag slider and cause it to move with the slider assembly; and a controller which controls the motion of the slider assembly and the second indexer.

20. The apparatus of claim 19 wherein the slider assembly portions which are positioned to engage the bag slide comprise an engagement member having two tines which define a locating fork, the engagement member being mounted for vertical movement, such that when the locating fork descends on a bag, the sides of the bag will be directed between the two tines.

21. The apparatus of claim 19 further comprising:

a vertical actuator mounted to the frame for side to side movement above a bag mouth; and a spreader member fixed to a vertical member of the vertical actuator, for vertical motion thereon, and rotatably mounted for rotation about a vertical axis, the spreader member having a narrow dimension and a wide dimension of greater dimension than the narrow dimension, the spreader member being movable between a first position spaced from the bag mouth, and a second position in which the spreader member is inserted into the bag mouth and interposed between the rear track and the front track of the bag, wherein rotation of the spreader member about the vertical axis permits the wedge to be rotated between an inserted orientation in which the narrow dimension separates the rear track from the front track a first amount, and a filling orientation, in which the wide dimension separates the rear track from the front track a second, greater amount to define a filling opening.

22. The apparatus of claim 21 the vertical actuator is mounted to the slider assembly for movement together with the slider assembly.

* * * * *